US007855639B2

(12) United States Patent
Patel et al.

(10) Patent No.: US 7,855,639 B2
(45) Date of Patent: Dec. 21, 2010

(54) DYNAMIC RESOURCE ASSIGNMENT AND EXIT INFORMATION FOR EMERGENCY RESPONDERS

(75) Inventors: Hemang F. Patel, Hoffman Estates, IL (US); Anthony R. Metke, Naperville, IL (US)

(73) Assignee: Motorola, Inc., Schaumburg, IL (US)

( * ) Notice: Subject to any disclaimer, the term of this patent is extended or adjusted under 35 U.S.C. 154(b) by 648 days.

(21) Appl. No.: 11/767,610

(22) Filed: Jun. 25, 2007

(65) Prior Publication Data

US 2008/0314681 A1 Dec. 25, 2008

(51) Int. Cl.
*G08B 1/08* (2006.01)

(52) U.S. Cl. ..... 340/539.2; 340/539.11; 340/539.26; 340/521; 340/522; 340/691.6

(58) Field of Classification Search ..... 340/539.1, 340/539.2, 539.11, 539.26, 539.27, 506, 340/507, 521, 522, 628, 632; 362/227; 381/56, 381/57

See application file for complete search history.

(56) References Cited

U.S. PATENT DOCUMENTS

| | | | | |
|---|---|---|---|---|
| 5,815,126 | A * | 9/1998 | Fan et al. | 345/8 |
| 6,873,256 | B2 | 3/2005 | Lemelson | |
| 7,259,656 | B1 * | 8/2007 | Wright | 340/286.14 |
| 2005/0085257 | A1 * | 4/2005 | Laird et al. | 455/550.1 |
| 2005/0190053 | A1 * | 9/2005 | Dione | 340/500 |
| 2005/0250440 | A1 | 11/2005 | Zhou et al. | |
| 2006/0017558 | A1 | 1/2006 | Albert et al. | |
| 2006/0017559 | A1 | 1/2006 | Albert | |
| 2006/0017560 | A1 | 1/2006 | Albert | |
| 2006/0017561 | A1 | 1/2006 | Albert | |
| 2007/0279210 | A1 * | 12/2007 | Li et al. | 340/506 |
| 2008/0234928 | A1 * | 9/2008 | Matsuoka | 701/204 |

FOREIGN PATENT DOCUMENTS

| | | | |
|---|---|---|---|
| JP | 2006331290 | A | 12/2006 |
| JP | 2007034671 | A | 2/2007 |

OTHER PUBLICATIONS

PCT Search Report Dated Oct. 31, 2008.

* cited by examiner

*Primary Examiner*—Hung T. Nguyen
(74) *Attorney, Agent, or Firm*—Lalita Pace; Anthony P. Curtis

(57) ABSTRACT

A method of providing situational awareness at an incident scene. Sensor data can be received from at least one sensor (104, 106, 108) located at the incident scene and position data can be received for at least one resource (306, 308, 310, 312). Based on the received data, at least one optimal exit route (318) at the incident scene can be calculated. The present invention also relates to a system (118) that provides situational awareness at an incident scene. The system can include a communications adapter (204) that receives sensor data from at least one sensor located at the incident scene and position data for at least one resource located at the incident scene, and a processor (202) that calculates at least one optimal exit route for the resource to exit a location at the incident scene based on the received sensor data and position data.

21 Claims, 3 Drawing Sheets

DYNAMIC RESOURCE ASSIGNMENT AND EXIT INFORMATION FOR EMERGENCY RESPONDERS

BACKGROUND OF THE INVENTION

1. Field of the Invention

The present invention generally relates to communications systems and, more particularly, to emergency response communications systems.

2. Background of the Invention

Emergency responders at an incident scene often are confronted with a number of issues, one of which is resource management. During a structure fire, for example, an emergency response coordinator typically decides how to allocate emergency response resources (e.g. personnel, equipment, etc.) to attack the fire, and then provides instructions to personnel to implement the resource allocations. The decision making process is usually based on situational assessments made by analyzing human sensory perceptions and by gathering information from bystanders. Oftentimes, such perceptions and information gathered are insufficient to provide adequate situational awareness. In consequence, the emergency response resources may not be allocated in a manner which maximizes their effectiveness. Moreover, some emergency response resources may be placed in unacceptably risky situations.

Another issue that emergency responders confront is the issue of planning for the safe exit of emergency response resources from the incident scene. For instance, during a structure fire, emergency responders need to be able to find a safe exit from the structure should the fire create unacceptably dangerous conditions within the structure. Exit signs may be damaged or hidden from view due to smoke or debris, however, and certain exit routes also may be blocked. Emergency responders therefore may be unaware of the safest exit path and may be exposed to danger longer than is necessary.

SUMMARY OF THE INVENTION

The present invention relates to a method of providing situational awareness at an incident scene. The method can include receiving sensor data from at least one sensor located at the incident scene and receiving position data for at least one resource located at the incident scene. Based on the received sensor data and position data, at least one optimal exit route for the resource to exit a location at the incident scene can be calculated.

The present invention also relates to a system that provides situational awareness at an incident scene. The system can include a communications adapter that receives sensor data from at least one sensor located at the incident scene and position data for at least one resource located at the incident scene. The system can also include a processor that calculates at least one optimal exit route for the resource to exit a location at the incident scene based on the received sensor data and position data.

The present invention can also be embedded in a program storage device readable by a machine, tangibly embodying a program of instructions executable by the machine to perform the various steps described herein.

BRIEF DESCRIPTION OF THE DRAWINGS

Preferred embodiments of the present invention will be described below in more detail, with reference to the accompanying drawings, in which.

DETAILED DESCRIPTION

While the specification concludes with claims defining features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The present invention relates to a method and a system that provides situational awareness at an incident scene. The system can process sensor data received from the incident scene and calculate safe exit routes for emergency responders and other emergency response resources at the scene. For instance, if there is a structure fire at the incident scene, the system can calculate safe exit routes out of the structure. Further, the system can process sensor data to determine when the emergency response resources should begin exiting the structure.

Figure 1:
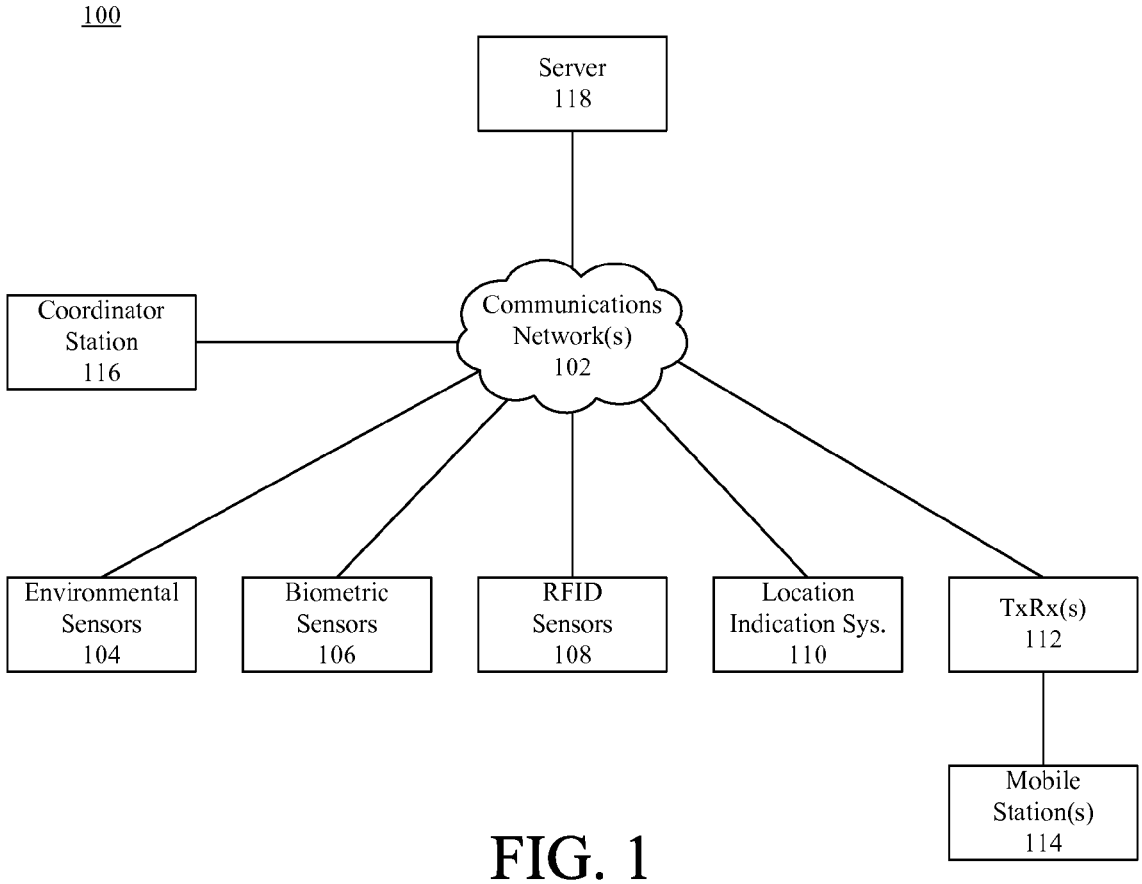
FIG. 1 depicts a communications system that is useful for understanding the present invention.

FIG. 1 depicts a communications system 100 that is useful for understanding the present invention. The communications system 100 can include a communications network 102, which may comprise a wide area network (WAN), such as the Internet, the World Wide Web, a dispatch communications network, an interconnect communications network (e.g. a cellular communications network), a public switched telephone network (PSTN), and the like. The communications network also may comprise a local area network (LAN), a metropolitan area network (MAN), a WiFi network, a Mesh network, a public safety network (e.g. Astro, TETRA, HPD, etc.) and/or any other networks or systems over which communication signals can be propagated. In that regard, the communications network 102 can include wired and/or wireless communication links. The communications network 102 can be configured to communicate data via IEEE 802 wireless communications, for example, 802.11 and 802.16 (WiMAX), 3G, 4G, EUTRAN, UMB, WPA, WPA2, GSM, TDMA, CDMA, WCDMA, OFDM, direct wireless communication, or any other communications format. Indeed, the communications network 102 can be implemented in accordance with any suitable communications standards, protocols, and/or architectures, or a suitable combination of such standards, protocols, and/or architectures.

The communications system 100 can also include one or more sensors, for example environmental sensors 104, biometric sensors 106 and/or radio frequency identifier (RFID) sensors 108. The environmental sensors 104 can monitor environmental conditions at the incident scene. For example, the environmental sensors 104 can monitor temperature, humidity and air quality (e.g. carbon monoxide levels, carbon dioxide levels, oxygen levels, nitrogen levels, smoke levels, airborne particulates, fumes, leaking gas, etc.). The environmental sensors 104 can also monitor positions of structural features, structural movement, structural fatigue, structural failures and/or any other structural parameters which may be measured with a suitable sensor. In addition, the environmental sensors 104 can monitor positions of items or personnel disposed within or proximate to a structure. Examples of suitable environmental sensors 104 can include, but are not limited to, video cameras, oxygen sensors, carbon monoxide sensors, carbon dioxide sensors, nitrogen sensors, thermometers, thermocouples, altimeters and transducers (e.g. microphones, accelerometers, stress sensors, and the like).

The environmental sensors 104 and/or RFID sensors 108 can be positioned at a potential incident scene. For example, the sensors 104, 108 can be installed within structures or other areas of a location. The sensors 104, 108 can be installed during development of the location, after the location has been developed, or in response to an emergency situation being identified at the location. The sensors 104, 108 can be communicatively linked to the communications network 102 via wired and/or wireless communications links. For example, the sensors 104, 108 can be communicatively linked to one or more switches, routers, access points, gateways, or any other suitable components linked to the communications network 102.

The biometric sensors 106 can measure biological parameters to generate biometric data, and can also be communicatively linked to the communications network 102 via wired and/or wireless communications links. The biometric sensors 106 can measure biological parameters of emergency response personnel, such as heart rates, respiration rates, oxygen levels, carbon dioxide levels, carbon monoxide levels, body temperatures, brain wave activities, blood chemistry, physical exertion levels, or any other biological parameters that may be measured. In one aspect of the inventive arrangements, the biometric sensors 106 can be carried on the person of personnel or attached to emergency response equipment.

The communications system 102 further can include a location indication system 110 that indicates the location of the incident scene. The location indication system 110 can include, for example, a global positioning system, a local positioning system, a beacon, a transponder, an RFID tag or any other system or device that indicates the location of the incident scene or the position of one or more resources at the incident scene. For example, in one arrangement the location indication system 110 can include a global positioning satellite (GPS) receiver carried by one or more resources at the incident scene. In another arrangement, such location can be indicated by a device or system installed at the incident scene that indicates the incident scene location. A signal from such a device or system can be communicated directly to emergency response equipment or communicated via the communications network 102.

One or more transceivers 112 can also be provided as components of the communications network 102. The transceivers 112 can modulate and demodulate signals to convert signals from one form to another, and can transmit and/or receive such signals over one or more various wireless communication links. The transceivers can be components of access points, base stations, repeaters, wireless routers, satellites, switches, or any other wireless network nodes. In illustration, the transceivers 112 can be configured to communicate data via IEEE 802 wireless communications, for example, 802.11 and 802.16 (WiMAX), WPA, or WPA2. In another example, the transceivers 112 can communicate data via GSM, TDMA, CDMA, WCDMA, OFDM, or direct wireless communication.

The transceivers 112 can support communications for one or more mobile stations 114 carried by emergency response personnel and provide access to the communications network 102. The transceivers 112 can also provide access to the communications network 102 for one or more of the environmental sensors 104, biometric sensors 106, RFID sensors 108 and/or location indication systems 110. The transceivers 112 can be installed at the incident scene, or carried by an emergency response vehicle to the incident scene. For instance, one or more of the transceivers 112 can be integrated into a mobile router.

The mobile stations 114 can be mobile telephones, mobile radios, personal digital assistants, mobile computers, or any other suitably configured wireless communication devices, for example the transceivers 112. In one arrangement, one or more of the mobile stations 114 can include a positioning system, such as a GPS receiver, a local positioning system or RFID tags that may be detected by the RFID sensors 108. The positioning systems can generate positioning data associated with respective resources, such as emergency responders and equipment located at the incident scene.

An example of a local positioning system is a system that receives signals from a plurality of signal generators, for instance transceivers 112, and implements trilateration in order to determine a respective location of a mobile station 114. The signal generators can be located within a building, a park, a city, or any other geographically defined region.

In another arrangement, one or more of the mobile stations 114 can transmit signals detectable by signal receivers (e.g. transceivers 112). Such signals can be processed to determine the respective locations of the mobile stations 114. For example, each mobile station 114 can transmit a positioning signal at a frequency and/or in a respective time slot that is allocated to the respective mobile station 114. The positioning signal can be in the radio frequency (RF) spectrum, ultraviolet (UV) spectrum, infrared (IR) spectrum, or any other suitable frequency spectrum. The plurality of receivers can receive the signals and generate timing information correlating to the respective positioning signals. The timing information can be forwarded to a server, such as a server 118, and processed to determine the respective locations using trilateration. In lieu of positioning signals, communication signals otherwise generated by the mobile stations 114 can be processed to generate the timing information that is used to determine the respective locations of the mobile stations 114.

The communications system 100 can also include a coordinator station 116, which can also be embodied as a mobile station, for example as a mobile computer or personal digital assistant. The coordinator station 116 can present situational awareness data to an emergency response coordinator. For example, the coordinator station 116 can present maps of the incident scene and map overlays to the emergency response coordinator, indicate locations of resources, and present data generated by the sensors 104-108 and the location indication system 110. Further, the coordinator station 116 can provide a communication link to the mobile stations 114 via which the emergency response coordinator can communicate resource allocation instructions, as well as other messages, to resources/personnel. Such messages can comprise audio, video, text, data and the like. The coordinator station 116 can also provide a communication link to other resources that may or may not be located at the incident scene.

In one arrangement, the server 118 can be communicatively linked to the coordinator station 116. In another arrangement, the coordinator station 116 and the server 118 can be provided as a single system which supports communication between coordinator station applications and server applications.

In operation, the server 118 can receive and process information received from the environmental sensors 104, the biometric sensors 106, the RFID sensors 108, the location indication system 110, the mobile stations 114 and/or the coordinator station 116. The server 118 can also implement trilateration, as previously described, to track the location of the respective mobile stations 114. In addition, the server 118 can receive messages that relay requests, data updates, and other information that may be processed to provide situational awareness. For example, the server 118 can receive resource assignments from the coordinator station 116 and can compute optimal exit routes for resources to exit a location at the incident scene. Such location can be a structure, a geographic region, or the like.

In addition to receiving and processing information, the server 118 can also communicate data generated by such processing. For example, the server 118 can communicate messages to the coordinator station 118 and/or the mobile stations 114 in response to requests received from such entities. The server 118 can also provide mapping information to the coordinator station 116 and/or the mobile stations 114, can indicate the respective locations of the mobile stations 114 or other resources within the incident scene, can indicate respective directions of movement and can provide information related to the optimal exit routes that were computed. For example, the server 118 can communicate location maps and map overlay information. On the maps, the map overlay information can indicate the respective positions of the mobile stations 114 (and/or other resources), their respective directions of movement, and the optimal exit routes. Further, the server 118 can provide an indicator that indicates when resources should exit the incident scene.

Figure 2:
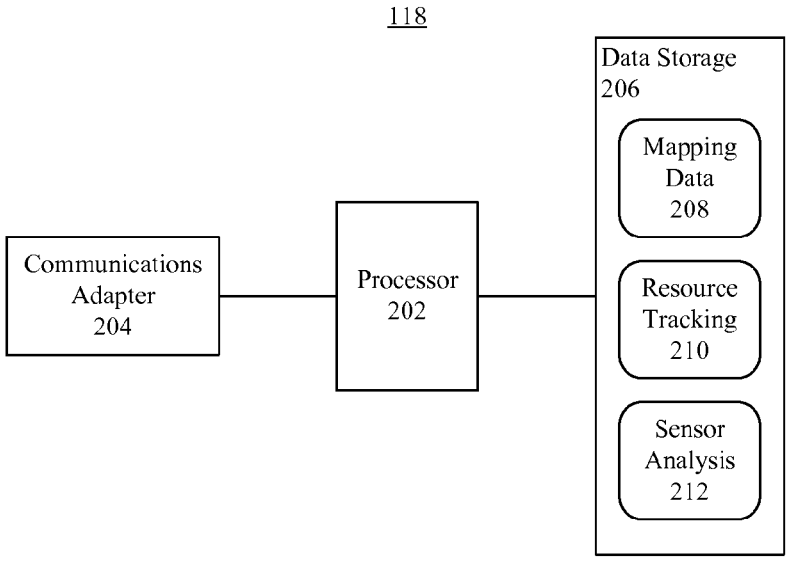
FIG. 2 depicts a block diagram of a server that is useful for understanding the present invention.

FIG. 2 depicts a block diagram of a server 118 that is useful for understanding the present invention. The server 118 can be any suitable processing system or group of processing systems. In that regard, the server 118 can include a processor 202, which can comprise, for example, one or more central processing units (CPUs), one or more digital signal processors (DSPs), one or more application specific integrated circuits (ASICs), one or more programmable logic devices (PLDs), a plurality of discrete components that can cooperate to process data, and/or any other suitable processing device. In an arrangement in which a plurality of such components are provided, the components can be coupled together to perform various processing functions as described herein.

The server 118 can also include a communications adapter 204 that is communicatively linked to the processor 202. The communications adapter 204 can be any data send/receive device that is suitable for communicating via a communications network. For example, the communications adapter 204 can be a transceiver that is configured to wirelessly communicate via a base transceiver station, a repeater, an access point, or any other suitable wireless network device. As such, the communications adapter 204 can communicate data via IEEE 802 wireless communications, for example, 802.11 and 802.16 (WiMAX), 3G, 4G, WPA, WPA2, GSM, TDMA, CDMA, WCDMA, OFDM, direct wireless communication and/or any other suitable wireless communication protocols. In another arrangement, the communications adapter 204 can be a wired communication port or a network adapter configured to communicate via wired communication, for instance via a switch or a router. The communications adapter 204 can communicate data via TCP/IP and/or any other suitable communication protocols.

The communications adapter 204 can receive sensor data generated by the various sensors, location information associated with the incident scene, position information for various resources, messages, and any other data communicated to the server 118. The communications adapter 204 can also communicate maps, map overlay information, messages, and any other data communicated from the server 118.

The server 118 can also include a data storage 206. The data storage 206 can include one or more storage devices, each of which can include, but is not limited to, a magnetic storage medium, an electronic storage medium, an optical storage medium, a magneto-optical storage medium, and/or any other storage medium suitable for storing digital information. In one arrangement, the data storage 206 can be integrated into the processor 202, though this need not be the case.

Mapping data 208 can be contained on the data storage 206, as well as a resource tracking application 210 and a sensor analysis application 212. The mapping data 208 can include maps for a plurality of locations that are potential incident scenes, including, but not limited to, maps of geographic regions, cities, neighborhoods, parks, structures (including internal layout information), and the like. The mapping data 208 can be stored in a database, data tables, data files, or in any other suitable manner.

The resource tracking application 210 and sensor analysis application 212 can be executed by the processor 202 to implement the methods and processes described herein that are allocated to the server 118. For example, at runtime the sensor analysis application 212 can receive sensor data from the various sensors providing sensor data from the incident scene, and analyze the sensor data to generate situational awareness information, such as information related to oxygen levels, carbon monoxide levels, carbon dioxide levels, nitrogen levels, temperatures, structural fatigue, blocked passageways, biometric information for emergency responders, and so on.

The resource tracking application 210 can receive resource allocation information from the coordinator station and situational awareness information from the sensor analysis application 212. The tracking application 210 can also receive or compute the positions of the respective resources, their distance from one or more optimal/safe exits, their direction of movement and routes to optimal/safe exits, as previously described. Further, the tracking application 210 can determine when to require certain resources to exit from a location.

For example, the tracking application 210 can monitor body temperature data received from a biometric sensor associated with a particular emergency responder, as well as ambient temperature data received from an environmental sensor within a structure in which the emergency responder is located. The tracking application 210 can also estimate an amount of time likely to be required for the emergency responder to exit the structure following an available exit route. Based on the biometric and environmental temperature data, the tracking application 210 can determine when it is likely the emergency responder's body temperature (or other physical parameter) will reach an unsafe level. The tracking application 210 can signal the emergency responder to exit the structure in a manner that insures the emergency responder has adequate time to exit the structure before the body temperature (or other parameter) reaches the unsafe level.

For instance, if it is estimated that the emergency responder needs five minutes to exit the structure following a safe exit route, and it is estimated that the emergency responder's body temperature will reach an unsafe level at 4:01 P.M., the tracking application 210 can signal the emergency responder to begin exiting the structure no later than 3:56 P.M. The tracking application 210 can also indicate to the emergency responder the optimal exit route that should be followed.

Further, the tracking application 210 can estimate an amount of time an optimal exit route may remain available. For instance, based on sensor data, the tracking application 210 can monitor a rate at which a fire is spreading and/or debris is falling within a structure and estimate when the fire and/or debris likely will block a particular exit. If it is anticipated that the optimal exit route will be unavailable by a certain time, the tracking application 210 can signal the emergency responder to begin exiting the structure to insure that the emergency responder has adequate time to safely exit. For instance, if it is anticipated that the optimal exit route will only remain available until 3:56 P.M. and it is estimated that the emergency responder should need no more than five minutes to exit, tracking application 210 can signal the emergency responder to begin exiting the structure no later than 3:51 P.M.

The tracking application 210 can also monitor other potential exit routes that may be used by emergency responders, for example if the optimal exit route should become unavailable. If the exit path that was originally considered optimal becomes blocked or is no longer deemed optimal, a second exit route can be selected as the optimal exit route. By way of example, if it is estimated that the first optimal exit route will become unavailable in five minutes, but an emergency responder is available to stay at the location for longer than five minutes, a second exit route which is anticipated to remain available for an adequate amount of time for the emergency responder to safely exit the location can be selected as the optimal exit route for that emergency responder. In addition, one or more other exit routes can be selected as alternatives to the second exit route should the second exit route become unavailable. The first exit route may remain the optimal exit route for other emergency responders who may begin exiting with adequate time to exit along the first exit route, though this not need be the case as such emergency responders also may be instructed to proceed along the second exit route.

Data can be generated to visually present the optimal exit route on one or more displays viewable by the emergency responder and/or the response coordinator. For example, from the mapping data, resource allocation information, situational awareness information and position information, the resource tracking application 210 can generate map overlay data. In addition to the optimal exit route, the map overlay data can include at least one icon corresponding to an emergency responder, a status indicator that is associated with the emergency responder, a status indicator that presents environmental data, instructions conveyed or to be conveyed to emergency responders, and so on.

The tracking application 210 can communicate a map and map overlay data to the coordinator station and/or the mobile stations via the communications adapter 204. The tracking application 210 can also periodically update the map overlay data and communicate such updates to the coordinator station and/or the mobile stations via the communications adapter 204.

Figure 3:
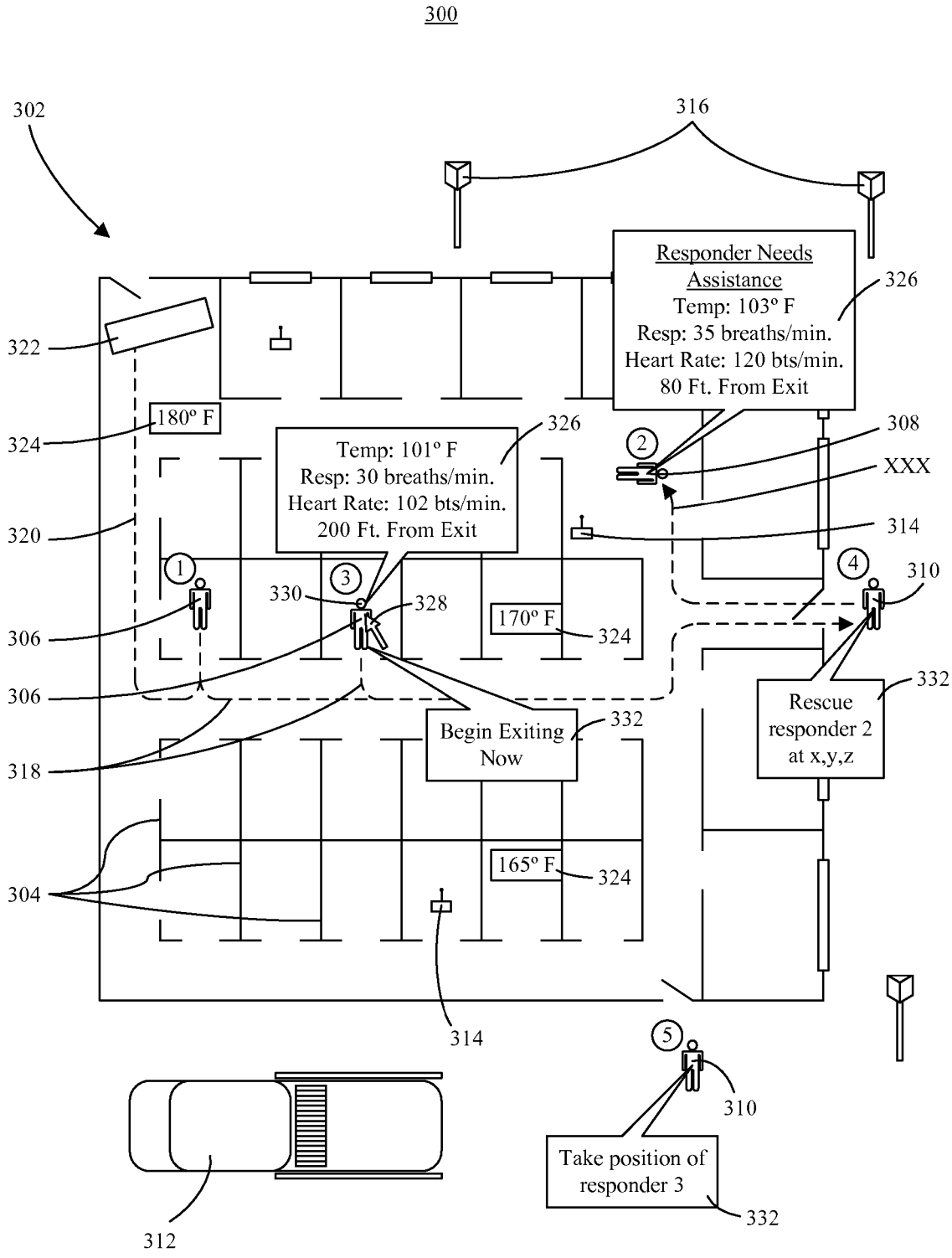
FIG. 3 depicts a map that is useful for understanding the present invention.

FIG. 3 illustrates an example of a map with map overlay information (collectively referred to as map 300) that may be generated by the resource tracking application 210 to visually present situational awareness information. The map 300 can depict structures 304 at the incident scene 302, as well as resources, such as personnel 306, 308, 310 and equipment 312. The map 300 can also display access points 314 and base transceiver stations/repeaters 316.

The map 300 can also depict the optimal exit routes 318 computed for resources (e.g. personnel 306, 308). For example, an exit route 320, which may be the shortest exit route, may be blocked by an obstacle 322. The tracking application 210 can detect such obstacle 322 via data received from an environmental sensor, such as a video camera, and compute the exit route 318 as an alternate route that is optimal given the current environmental conditions.

The map 300 further can depict status indicators 324 that present data received from the various environmental sensors. Status indicators 326 associated with emergency responders 306, 308 can also be depicted. The status indicators 326 can present biometric data received from biometric sensors, as well as any other desired information, for instance whether an emergency responder 308 needs assistance and/or the emergency responder's distance from the exit. The biometric data for a particular emergency responder 306, 308 can be presented continuously, periodically, or when a cursor 328 is placed over an icon 330 representing the emergency responder 306.

In addition, the map 300 can indicate instructions 332 to be implemented for resources, for instance when to begin exiting a structure, rescue another responder, replace another responder at a position, and so on. Such instructions can be communicated from the coordinator station and/or one or more mobile stations. In one aspect of the inventive arrangements, the instructions can be entered verbally, and speech recognition can be used to convert the verbal instructions to text. For instance, a speech recognition application can be instantiated on the coordinator station and/or the mobile stations.

Figure 4:
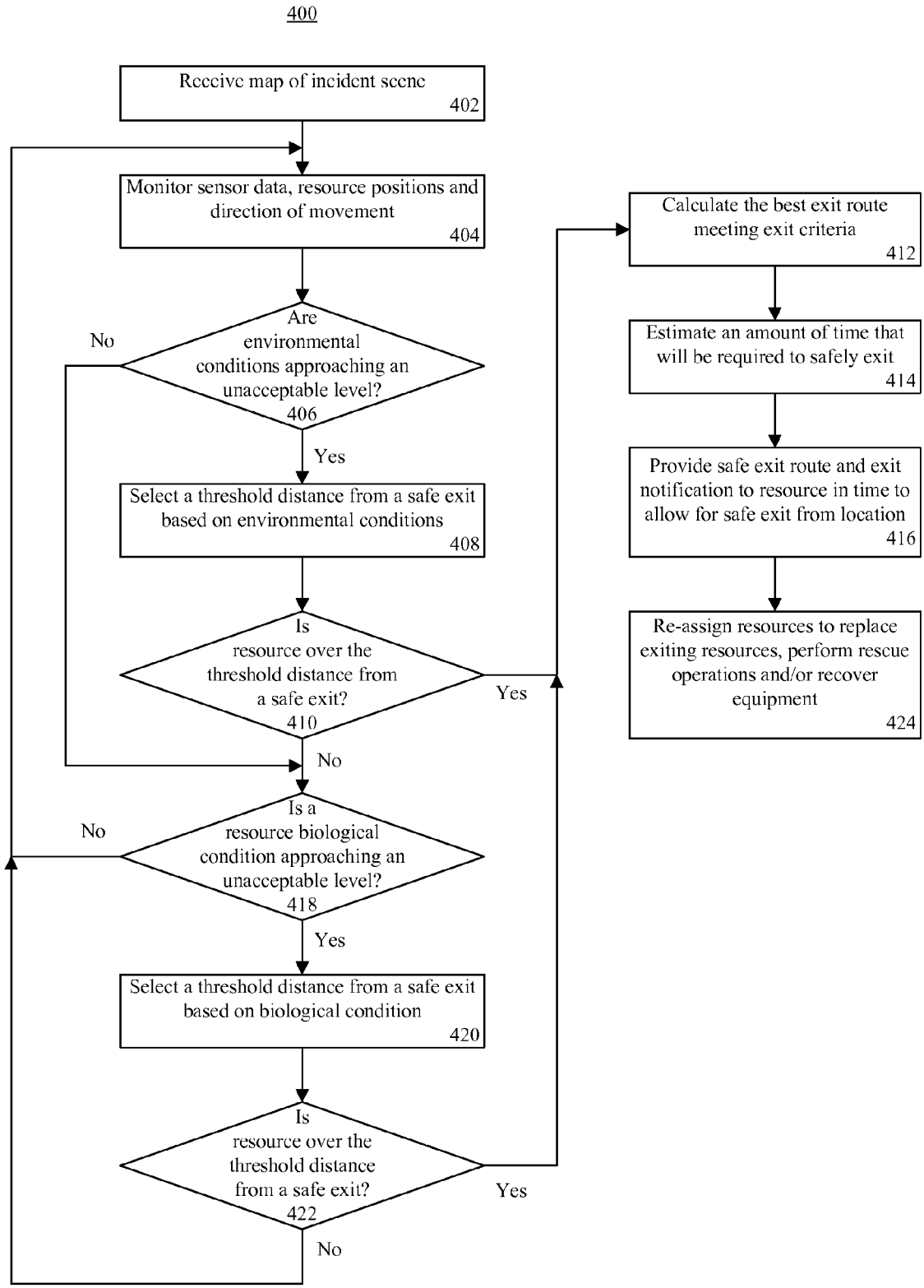
FIG. 4 is a flowchart that is useful for understanding the present invention.

FIG. 4 is a flowchart that presents a method 400 of providing situational awareness that is useful for understanding the present invention. Beginning at step 402, a map of the incident scene can be received. For instance, a server can receive location information from a location indication system or the location information can be manually entered. At step 404, sensor data from various environmental and biometric sensors can be monitored, as well as the positions of resources at an emergency scene and their direction of movement. The respective positions can be monitored via a global positioning system, local positioning system, RFIDs, or in any other suitable manner.

Referring to decision box 406, if the environmental sensors indicate that one or more environmental conditions (e.g. gas level(s), structural integrity, temperature, etc.) is approaching an unacceptable level, at step 408 a threshold distance from a safe exit can be selected based on the environmental conditions. For example, if the environmental sensors detect a level of gas or a gas leak that is higher than a threshold value, a particular distance can be selected as a threshold distance.

At decision box 410, if a resource (e.g. emergency responder) is over the threshold distance away from a safe exit, at step 412 an optimal exit route can be calculated. In one arrangement, the optimal exit calculation can choose the shortest exit route that meets certain exit criteria. Such criteria can include any criteria that may be considered in selecting a suitable exit route. Examples of such criteria can include, but are not limited to, rules based on whether the route is blocked by an obstacle (e.g. furniture or debris), whether the temperature along the route exceeds a threshold temperature or is higher than temperatures along other available routes, whether fire is detected on the route, gas levels along the route and other available routes, and so on.

As noted, one or more additional exit routes can also be calculated for use should the optimal exit route become unavailable or no longer meet the exit criteria. Such additional exit routes can be prioritized based on the exit criteria to identify the next best exit route, the third best exit route, and so on. The first optimal exit route and alternative exit routes can be monitored and re-prioritized as conditions at the location change.

At step 414, an amount of time that will be required for the resource to safely exit from its current location can be estimated. At step 416, safe exit route information, such as a map overlay, can be provided to the resource. The map overlay can be presented to an emergency responder on a mobile station, for example. In addition, an exit notification message can be provided to prompt withdrawal of the resource from the location with adequate time to allow for a safe exit. For instance, if it is estimated that the time to exit the location will be approximately two minutes, and it is estimated that gas levels caused by a gas leak will exceed a threshold value at 2:45 P.M., the exit notification can be provided at 2:43 P.M., or earlier.

Referring again to decision boxes 406 and 410, if the environmental conditions are not approaching an unacceptable level or the resources are adequately near a safe exit with respect to environmental conditions that are present, the process can proceed to decision box 418 and a determination can be made whether a biological condition (e.g. heart rate, breathing rate, body temperature, etc.) is approaching an unacceptable level. If so, at step 420 a threshold distance from a safe exit can be selected based on the biological condition. For example, if a heart rate or breathing rate is approaching an unacceptable level, a particular distance can be selected as a threshold distance. At decision box 422, if a resource (e.g. emergency responder) is over the threshold distance away from a safe exit, the process can again proceed to steps 412-424 as previously described.

For example, assume that an emergency responder's body temperature is rising at a particular rate, and at the current rate of increase the body temperature will reach a threshold value in ten minutes. Also assume that, based on the best exit route that was calculated, it is estimated that it will take six minutes for the emergency responder to exit the current location. Within four minutes (or less) from the current time the exit notification can be provided to the emergency responder.

In addition to providing safe exit route information and exit notifications, at step 424 the process can also include reassigning resources to replace exiting resources, to perform rescue operations for injured emergency responders and/or to recover emergency response equipment.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The present invention can be realized in hardware, software, or a combination of hardware and software. The present invention can be realized in a centralized fashion in one processing system or in a distributed fashion where different elements are spread across several interconnected processing systems. Any kind of processing system or other apparatus adapted for carrying out the methods described herein is suited. A typical combination of hardware and software can be a processing system with an application that, when being loaded and executed, controls the processing system such that it carries out the methods described herein. The present invention can also be embedded in a program storage device readable by a machine, tangibly embodying a program of instructions executable by the machine to perform methods and processes described herein. The present invention can also be embedded in an application product which comprises all the features enabling the implementation of the methods described herein and, which when loaded in a processing system, is able to carry out these methods.

The terms "computer program," "software," "application," variants and/or combinations thereof, in the present context, mean any expression, in any language, code or notation, of a set of instructions intended to cause a system having an information processing capability to perform a particular function either directly or after either or both of the following: a) conversion to another language, code or notation; b) reproduction in a different material form. For example, an application can include, but is not limited to, a subroutine, a function, a procedure, an object method, an object implementation, an executable application, an applet, a servlet, a MIDlet, a source code, an object code, a shared library/dynamic load library and/or other sequence of instructions designed for execution on a processing system.

The terms "a" and "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language).

This invention can be embodied in other forms without departing from the spirit or essential attributes thereof. Accordingly, reference should be made to the following claims, rather than to the foregoing specification, as indicating the scope of the invention.

What is claimed is:

1. A method of providing coordinated exit assistance at an incident scene, comprising a processor:

receiving sensor data from a sensor located at the incident scene;

receiving position data for an emergency responder located at the incident scene;

based on the received sensor data and position data, calculating a first exit route for the emergency responder to exit the incident scene and determining when to require exit of the emergency responder from the incident scene by estimating the time for the emergency responder to reach safety from the incident scene using the first exit route and estimating the time that the emergency responder is able to remain at the incident scene, wherein estimating the time that the emergency responder is able to remain at the incident scene comprises estimating the time for biometric data of the emergency responder to reach an unsafe level.

2. The method of claim 1, wherein estimating the time for the emergency responder to remain at the incident scene comprises estimating the time that the first exit route will remain available.

3. The method of claim 1, further comprising the processor:

continually monitoring potential exit routes usable by the emergency responder, the potential exit routes initially being less optimal than the first exit route;

determining whether one of the potential exit routes becomes more optimal than the first exit route;

replacing the first exit route with the one of the potential exit routes after the one of the potential exit routes becomes more optimal than the first exit route; and determining when to require exit of the emergency responder from the incident scene by estimating the time for the emergency responder to reach safety from the incident scene using the one of the potential exit routes and re-estimating the time that the emergency responder is able to remain at the incident scene.

4. The method of claim 3, wherein determining whether one of the potential exit routes becomes more optimal than the first exit route comprises:

estimating the time that the first exit route will remain available;

estimating the time that the one of the potential exit routes will remain available; and determining that the one of the potential exit routes has become more optimal than the first exit route when the estimated time that the one of the potential exit routes will remain available is greater than the estimated time that the emergency responder is able to remain at the incident scene and is greater than the estimated time that the first exit routes will remain available.

5. The method of claim 4, wherein estimating the time that a particular exit route will remain available includes estimating when at least one of fire or debris is likely to block a particular exit associated with the particular exit route.

6. The method of claim 3, further comprising if multiple emergency responders are present at the location, the processor independently determining which of the potential exit routes and first exit route is optimal for each emergency responder such that the emergency responders are able to use different exit routes at different times.

7. The method of claim 1, wherein calculation of the first exit route comprises choosing the shortest exit route that meets exit criteria including rules based on physical and environmental conditions along the route and biometric conditions of the emergency responder.

8. The method of claim 7, further comprising the processor continually monitoring and prioritizing additional exit routes based on the exit criteria.

9. The method of claim 1, further comprising the processor re-assigning another emergency responder from another location to the incident scene to at least one of: replace the emergency responder when exit of the emergency responder from the incident scene is required, perform rescue operations for the emergency responder when the emergency responder is injured or recover equipment of the emergency responder who has exited the incident scene but left the equipment at the incident scene.

10. The method of claim 1, further comprising the processor calculating information including positions, directions of travel and optimal exit routes of as well as distances to optimal exits for the emergency responders, and providing the information to each emergency responder.

11. The method of claim 1, further comprising displaying on a portable display carried by the emergency responder map overlay data that includes structures at the incident scene, an icon corresponding to a different emergency responder at the incident scene, the first exit route, and instructions to be conveyed to the emergency responder including at least one of: when to begin exiting the incident scene, whether the different emergency responder requires assistance, or whether to replace the different emergency responder.

12. The method of claim 11, wherein the portable display further displays status indicators that present biometric data of the emergency responder and the different emergency responder, environmental data at the incident scene, and distances of the emergency responder and the different emergency responder from exits to be used by the emergency responder and the different emergency responder.

13. A system comprising a processor employing biometric data of an emergency responder and structural parameters and environmental data of the incident scene to determine an optimal exit route from the incident scene for the emergency responder and to estimate a time that the emergency responder is to exit the incident scene by determining an exit having the shortest distance from the first responder, and a display to provide the optimal exit route and alert the emergency responder when to exit the incident scene.

14. The system of claim 13, wherein the processor determines a direction of travel that the emergency responder is moving and selects the optimal exit route and exit using the direction of travel.

15. The system of claim 13, wherein in determining the optimal exit route and when to exit the incident scene, the processor estimates the time that the optimal exit route will remain available by estimating when an earliest time at which environmental hazards or debris is likely to block the exit from being reached using the optimal exit route by employing the structural parameters and environmental data of the incident scene.

16. The system of claim 13, wherein the processor continually monitors potential exit routes to the exit and other exits that are usable by the emergency responder and are initially less optimal than the optimal exit route, determines whether one of the potential exit routes becomes more optimal than the optimal exit route, and if so re-estimates the time that the emergency responder is to exit the incident scene using the one of the potential exit routes rather than the optimal exit route, and wherein the display redirects the emergency responder along the one of the potential exit routes and alerts the emergency responder as to the time that the emergency responder is to exit the incident scene using the one of the potential exit routes rather than the optimal exit route.

17. The system of claim 13, wherein the processor independently determines an optimal exit route and associated exit, as well as independently estimating an exit time using the independently determined optimal exit route and associated exit, for each of a plurality of emergency responders at the incident scene using biometric data and structural parameters and environmental data unique to the particular emergency responder.

18. The system of claim 13, wherein the processor continually monitors and prioritizes additional exit routes based on the structural parameters and environmental data of the incident scene.

19. The system of claim 13, wherein the processor reassigns another emergency responder from another location to the incident scene to at least one of: replace the emergency responder when exit of the emergency responder from the incident scene is required, perform rescue operations for the emergency responder when the emergency responder is injured or recover equipment of the emergency responder who has exited the incident scene but left the equipment at the incident scene.

20. A method of providing coordinated exit assistance at an incident scene, comprising a processor:

receiving sensor data from a sensor located at the incident scene;

receiving position data for an emergency responder located at the incident scene;

based on the received sensor and position data as well as data indicating the direction of travel for the emergency responder, determining an exit for the emergency responder to exit the incident scene and calculating an optimal exit route to the exit, wherein the exit is the shortest distance from the emergency responder in a direction of travel of the emergency responder and may be different than an exit that is the shortest distance from the emergency responder.

21. The system of claim 20, further comprises using biometric data of an emergency responder and structural parameters and environmental data of the incident scene obtained from sensors to calculate the optimal exit route.

* * * * *